United States Patent [19]

Krape

[11] 4,310,942

[45] Jan. 19, 1982

[54] CHIMNEY CLEANING APPARATUS

[76] Inventor: Harry Krape, 409 Horton St., Wilkes Barre, Pa. 18702

[21] Appl. No.: 193,963

[22] Filed: Oct. 6, 1980

[51] Int. Cl.[3] ..... A46B 13/08

[52] U.S. Cl. ..... 15/162; 166/170

[58] Field of Search ..... 15/162, 163, 242, 243, 15/249, 104.16, 104.2; 166/170, 171, 172, 173, 174, 175, 176

[56] References Cited

U.S. PATENT DOCUMENTS

| | | | |
|---|---|---|---|
| 1,054,924 | 3/1913 | Latzsch et al. | 15/162 |
| 1,545,355 | 7/1925 | Roth | 15/243 |

FOREIGN PATENT DOCUMENTS

| | | | |
|---|---|---|---|
| 25455 | 8/1906 | Austria | 15/162 |
| 374383 | 4/1923 | Fed. Rep. of Germany | 15/162 |
| 2355236 | 1/1978 | France | 15/162 |

*Primary Examiner*—Peter Feldman

*Attorney, Agent, or Firm*—Anthony J. Dixon

[57] ABSTRACT

An apparatus for cleaning chimneys from a position at the bottom thereof comprising a brush cleaning member and a self-contained pulley system whereby the entire apparatus climbs the chimney from bottom to top in a stepwise fashion due to the actuation of two sets of retracting legs thereby cleaning the entire length of the chimney. The apparatus may be used to interchangeably accomodate different size brushes and legs so that various chimney and flue sizes and shapes can be cleaned.

7 Claims, 2 Drawing Figures

CHIMNEY CLEANING APPARATUS

BACKGROUND OF THE INVENTION

1. Field of the Invention

The present invention relates to an apparatus for the cleaning of chimneys of all sizes. More particularly, it relates to an apparatus for cleaning chimneys from the bottom up without the necessity of climbing to the top of the chimney.

2. Description of the Prior Art

Chimney cleaning mechanisms have long been known in the art; however the prior art apparatus such as disclosed by Campbell et al in U.S. Pat. No. 1,297,090, issued Mar. 11, 1919 requires extensive mechanisms which are permanently built into the chimney. Naturally, existing chimneys cannot benefit from such a system. Other prior art references such as U.S. Pat. No. 1,859,166 issued to Prembro on May 17, 1932, also requires extensive apparatus mounted permanently on the chimney with the mounting requiring work on the chimney top. Such mechanisms are outside the ability of the layman in the art.

With the advent of energy shortages, many persons find the once decorative home fireplace becoming an alternate, regularly used heating source and as a result, more rigorous cleaning to avoid the danger of chimney fire and to maintain the efficiency of the system is required.

The standard roof-type cleaning method requires the homeowner to undertake dangerous climbing to accomplish his purpose. Heretofore, the art has not solved this problem.

More recent systems, such as the apparatus disclosed by Anderson in U.S. Pat. No. 4,085,477, overcame the need for expensive fixed location equipment, only operable from the top of the chimney and still require rooftop or chimney-top operation. Further, the scrape-clean method can cause cracks or nicks in the flue liner of the chimney thereby causing a risk of fire.

An apparatus which is operable from the chimney bottom by a layman without the need for permanent installation of equipment is therefore needed to overcome the problem in the art.

SUMMARY OF THE INVENTION

An object of the present invention is to provide a chimney cleaning apparatus useable by the layman from a position on the ground.

More particularly, it is an object of the present invention to provide an inexpensive chimney cleaning apparatus whereby existing chimneys can be cleaned from the ground without the need for permanent modification of the chimney or permanent installation of equipment thereon.

The present invention overcomes the problem long faced in the art of cleaning a chimney without the need for a dangerous climb to the top thereof or without the need for permanent, unsightly apparatus mounted on the chimney top or roof. The apparatus of the invention comprises:

A. a resilient, compressible brush member of a size accomodatingly larger than the chimney to be cleaned, B. a first body plate having a centrally located aperture therein, C. means for releasably connecting said brush member to said first body plate whereby said brush member is located at a higher elevation in the chimney to be cleaned than said first body plate, D. a second body plate having a centrally located aperture therein, E. a first pulley rotationally mounted to said first body plate in a position spanning the aperture therein, F. a second pulley rotationally mounted to said second body plate in a position spanning the aperture therein, G. means for slidingly fastening said first body plate to said second body plate in a horizontal plane at a higher elevation in the chimney to be cleaned than the second body plate, whereby said body plates can be drawn together by said pulleys while maintaining the same alignment with respect to each other, H. means for activating said pulleys whereby said first and second body plates are drawn together, I. a plurality of springs interposed between said first and second body plates, said springs compressed as said body plates are drawn together and relaxed as said body plates move apart whereby the movement of the body plates toward each other is resisted, J. at least about two outwardly projecting legs retractably mounted on said first body plate, said legs spanning the width of the chimney to be cleaned when extended, whereby the apparatus is maintained in a fixed position in said chimney, K. at least about two outwardly projecting legs retractably mounted on said second body plate, said legs spanning the width of the chimney to be cleaned when extended, whereby the apparatus is maintained in a fixed position in said chimney, L. means for extending said legs on said first body plate in an outward and upward direction in said chimney whereby a downward movement of the first body plate is resisted, M. means for extending said legs on said second body plate in an outward and upward direction in said chimney whereby a downward movement of the second body plate is resisted, N. means for retracting said first body plate legs whereby said first body plate can move in an upward motion, O. means for retracting said second body plate legs whereby said second body plate can move in an upward motion whereby said apparatus moves in an upward motion in said chimney by upward motion of said first body plate due to upward force of said springs in step (i) followed by upward motion of said second body plate by activation of said pulleys thereby causing an upward step-wise motion of the entire apparatus of the invention resulting in a brushing of the entire length of the chimney to be cleaned.

DESCRIPTION OF THE PREFERRED EMBODIMENT

A better and complete understanding of the scope and principle of the present invention can be had by the following discussion with reference to the accompanying drawings.

Figure 1:
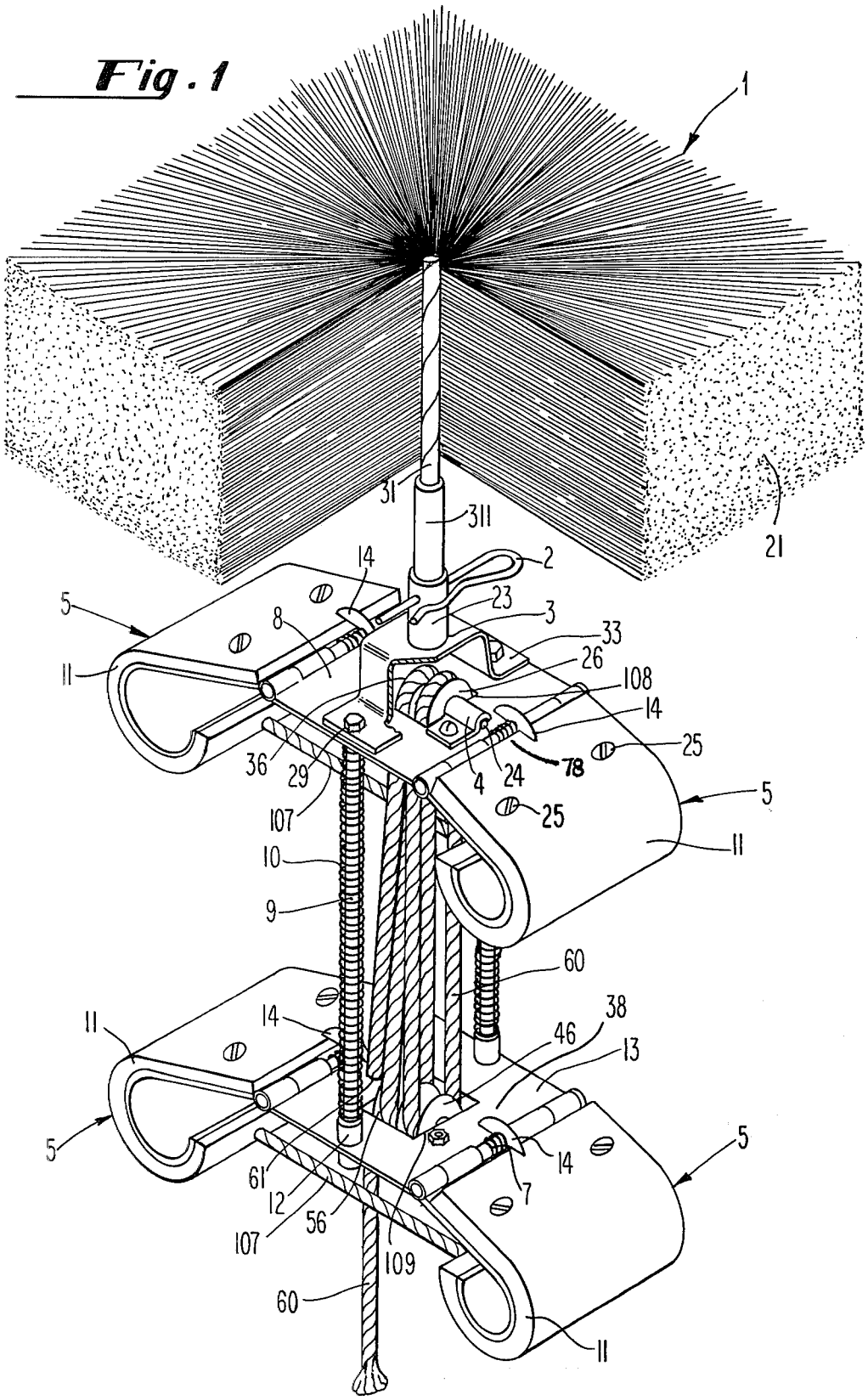
FIG. 1 is a front perspective of the apparatus of the invention in an expanded state.

Referring to the drawing FIG. 1, the apparatus of the invention outside of the chimney can be seen.

The components of the present invention include brush member 1, which is comprised of a bristle section, 21 and a stem section, 31, attached further to male connecting member 311.

The brush is mounted at 3 to the first body plate 8 by means of socket mount 23 affixed to the plate by support 33 into which member 311 fits in a sliding fashion. The brush is thereby releasably attached to allow for interchanging of brushes and although various releasable attachments can be used, the male-female socket with cotter pin 2 as shown is preferred.

The upper or first body plate 8 comprises a centrally located aperture 108 across which a first set of pulleys, 26 and 36, are mounted. Between them is located a link (not shown) to which reference will later be made.

These pulleys are mounted on shaft 24 which spans aperture 108 in top body plate 8. The shaft is held in position by retainer 4 as shown although any conventional shaft mounting technique can be substituted.

Mounted on the first plate are legs 5 which are retractable pivotally inward and downward so as to allow upward motion of the entire apparatus but to resist downward force. The legs extend outwardly until they meet opposing walls of the chimney to be cleaned. A spring-loaded hinge 78 is provided to allow this required movement. A covering or pad 11 of rubber or similar material can be provided to enchance the adhesion of the legs to the walls of the flue and is affixed to legs 5 by fasteners, 25. Four are preferred for a set of pads although more can be used.

A second or lower plate 13 is provided which is of similar construction to top plate 8. Legs 5, spring 7 and pads 11 act in a similar function as was the case in the top plate 8. The lower plate is also provided with aperture 109 across which pulleys 46 and 56 are mounted. A similar pulley shaft and retainer is provided but is not shown. Its construction is identical to items 8 and 24 above. On both plates, retainers 14 are provided to prevent legs 5 from rising beyond horizontal.

The body plates are connected by rods 9 which insures their relative alignment will remain constant. Bushing 12 is affixed to the lower plate which receives rods 9 in a sliding fashion. The upper ends of the rods are fixedly attached to the upper plate at 29. Helical or coil springs 10 circumferentially surround rods 9 so as to resist the approach of plate 8 to plate 13. At rest, the plates are most distant from each other.

The pulley in plate 8 is functionally connected to the pulley in plate 13 by means of rope or cord 60 which passes through an aperture 61 in plate 13, is threaded over pulleys 36, 56, 26, and 46 in that order, terminating at a connection where it is fixedly attached to the upper plate.

This connection is made to a link which is mounted around pulley shaft 24. The link is pear-shaped in the preferred embodiment. The shaft turns within this link and line 60 terminates at this fixed connection.

Figure 2:
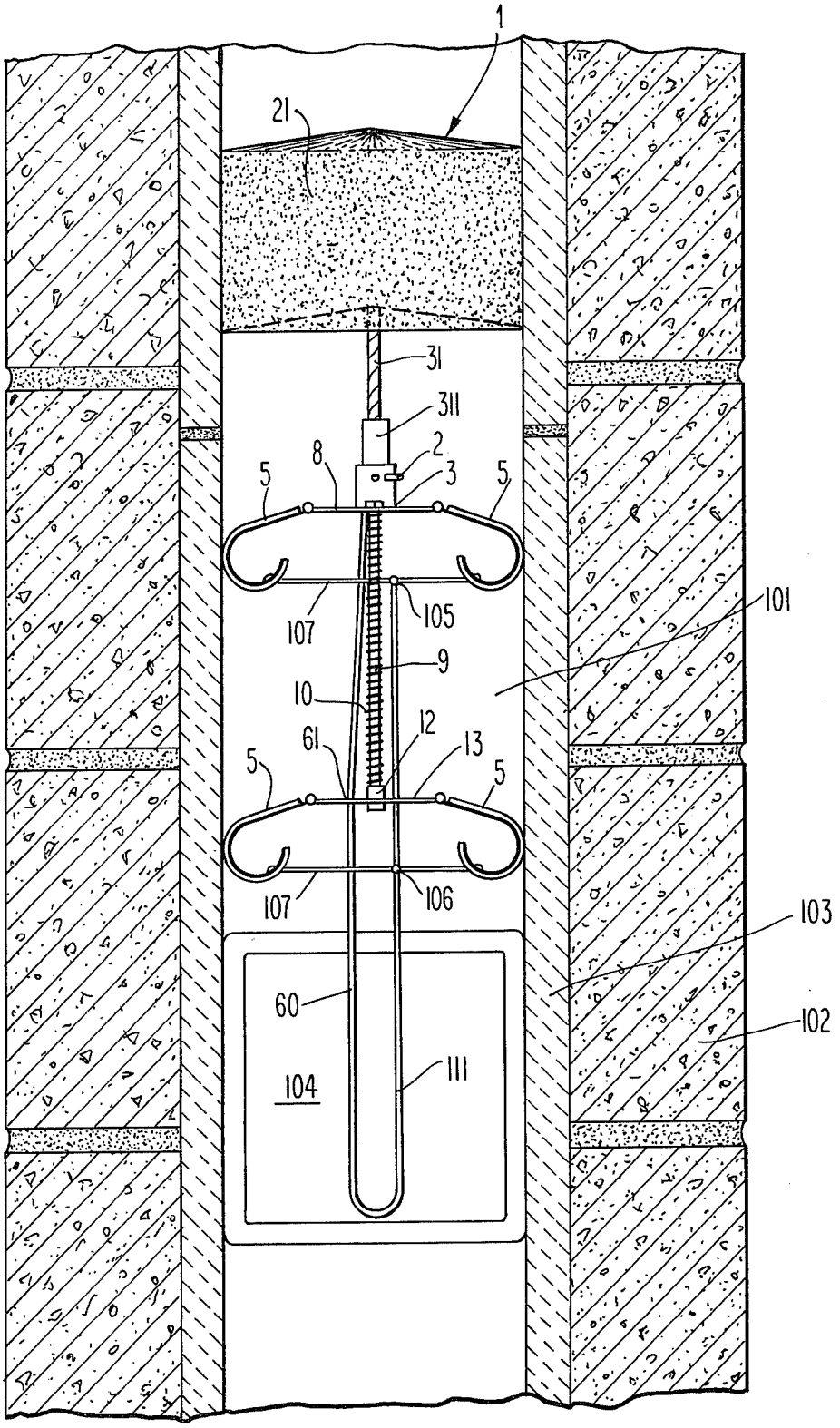
FIG. 2 is a vertical section of the apparatus engaged in a chimney flue.

Free end of rope 60 communicates (not shown in FIG. 1) with rope 111 (shown in FIG. 2). This rope connects at points 106 and 105 with leg retraction means 107.

As shown in FIG. 2, in actual operation, the entire unit with legs 5 folded inwardly or retracted is placed inside the chimney or flue, 101 to be cleaned. Usually this can be accomplished through the clean-out door 104 which is found on most chimneys. Once interior to the flue, with the brush above, the legs 5 are allowed to extend to meet the flue walls 103, thereby stationing the apparatus in the flue.

Since both leg sets resist downward force, a downward pull on cord 60 will not cause the upper plate to move downwardly, rather this force, when translated through pulleys 26, 36, 46, and 56 will cause an upward force on lower plate 13. The legs 5 will pivot inwardly and plate 13 will move upwardly sliding along rods 9. When plate 13 reaches the maximum compression point of springs 10, rope 60 is released. Since plate 13 will now resist a downward force from the expansion of springs 10, plate 8 will now be forced upward thereby forcing the brush up the chimney by the distance of the difference of the relaxed position of springs 10 and their compressed position. When the upward motion has stopped, the operator can pull on rope 60 to begin the process over again.

In this fashion, the entire apparatus, with the brush above it, moves step-wise to the top of the flue.

When the top is reached, rope 111 is pulled which, through connections 106 and 105, collapses legs 5. The unit will then freely slide back down the chimney being impeded only by the friction of the brush (1) against the chimney or flue walls.

If more serious cleaning is required, a second or third pass can be made.

The size of the brush or legs can be easily adapted to fit any flue or chimney size and any chimney height can be accomodated merely by lengthening rope 60.

Brush material may be selected from the group consisting of synthetic fiber, natural fiber, or steel wire, however, steel wire is preferred.

While the preferred embodiment of the present invention has been described herein in detail, various modifications are possible and may be made without departing from the overall scope and spirit of the invention herein described.

I claim as my invention:

1. An apparatus for cleaning a chimney flue comprising:

a. a resilient, compressible brush member of a size accomodatingly larger than the chimney to be cleaned;

b. a first body plate having a centrally located aperture therein;

c. means for releasably connecting said brush member to said first body plate whereby said brush member is located at a higher elevation in the chimney to be cleaned than said first body plate;

d. a second body plate having a centrally located aperture therein;

e. a first pulley rotationally mounted to said first body plate in a position spanning the aperture therein;

f. a second pulley rotationally mounted to said second body plate in a position spanning the aperture therein;

g. means for slidingly fastening said first body plate to said second body plate in a horizontal plane at a higher elevation in the chimney to be cleaned than the second body plate, whereby said body plates can be drawn together by said pulleys while maintaining the same alignment with respect to each other;

h. means for activating said pulleys whereby said first and second body plates are drawn together;

i. a plurality of springs interposed between said first and second body plates, said springs compressed as said body plates are drawn together and relaxed as said body plates move apart whereby the movement of the body plates toward each other is resisted;

j. at least about two outwardly projecting legs retractably mounted on said first body plate, said legs spanning the width of the chimney to be cleaned when extended, whereby the apparatus is maintained in a fixed position in said chimney;

k. at least about two outwardly projecting legs retractably mounted on said second body plate, said legs spanning the width of the chimney to be cleaned when extended, whereby the apparatus is maintained in a fixed position in said chimney;

l. means for extending said legs on said first body plate in an outward and upward direction in said chimney whereby a downward movement of the first body plate is resisted;

m. means for extending said legs on said second body plate in an outward and upward direction in said chimney whereby a downward movement of the second body plate is resisted;

n. means for retracting said first body plate legs whereby said first body plate can move in an upward motion;

o. means for retracting said second body plate legs whereby said second body plate can move in an upward motion;

whereby said apparatus moves in an upward motion in said chimney by upward motion of said first body plate due to upward force of said springs (i) followed by upward motion of said second body plate by activation of said pulleys thereby causing an upward step-wise motion of the entire apparatus of the invention resulting in a brushing of the entire length of the chimney to be cleaned.

2. The apparatus of claim 1 wherein said first pulley is comprised of two axially aligned pulleys and said second pulley is comprised of two axially aligned pulleys.

3. The apparatus of claim 2 wherein said slidingly fastening means (g) comprises at least about two cylindrical shafts fixedly mounted to said first body plate and slidingly mounted to said second body plate and wherein said springs (i) are circumferentially disposed on said cylindrical shafts.

4. The apparatus of claim 3 wherein the outwardly projecting legs (j) and (k) are each two in number and project in directions opposite to each other in wing-like fashion.

5. The apparatus of claim 4 wherein said means for extending said legs is an outward expanding spring mounted on each leg.

6. The apparatus of claim 5 wherein said means for retracting said legs is a line attached to each leg and activated from a position below the apparatus.

7. The apparatus of claim 6 wherein said brush (a) is constructed of resilient steel wire.

* * * * *